US011326342B1

(12) United States Patent
Moody

(10) Patent No.: US 11,326,342 B1
(45) Date of Patent: May 10, 2022

(54) EMBEDDED INTERLOCKING CROSS MEMBER BLOCKS

(71) Applicant: Brian Moody, Dunlap, TN (US)

(72) Inventor: Brian Moody, Dunlap, TN (US)

( * ) Notice: Subject to any disclaimer, the term of this patent is extended or adjusted under 35 U.S.C. 154(b) by 0 days.

(21) Appl. No.: 16/974,251

(22) Filed: Dec. 2, 2020

(51) Int. Cl.
*E04B 2/30* (2006.01)
*E04B 2/00* (2006.01)
*E04B 2/02* (2006.01)

(52) U.S. Cl.
CPC ..... *E04B 2/30* (2013.01); *E04B 2002/0247* (2013.01)

(58) Field of Classification Search
CPC ..... E04B 2/30; E04B 2002/0247
USPC ..... 52/474
See application file for complete search history.

(56) References Cited

U.S. PATENT DOCUMENTS 941,080 A * 11/1909 Larsen ..... E04B 2/30 52/565
2,647,392 A * 8/1953 Wilson ..... E04B 2/30 52/563
3,387,421 A * 6/1968 Robertson ..... E04C 1/40 52/436
3,597,890 A * 8/1971 Hala ..... E04B 1/32 52/309.17
4,075,808 A * 2/1978 Pearlman ..... E04B 2/54 52/439
4,229,920 A * 10/1980 Lount ..... E04C 2/205 52/426
4,357,783 A * 11/1982 Shubow ..... E04B 1/161 52/439
4,439,967 A * 4/1984 Dielenberg ..... E04B 2/26 52/439
4,510,726 A * 4/1985 MacDonald, Jr. ..... E04B 2/32 52/410
4,640,071 A * 2/1987 Haener ..... E04B 2/46 52/100
4,769,961 A * 9/1988 Gillet ..... E04B 2/54 52/592.4
5,459,970 A * 10/1995 Kim ..... E04B 1/165 52/424
5,799,453 A * 9/1998 Westerlund ..... E04B 1/161 52/250
5,845,449 A * 12/1998 Vaughan ..... E04C 1/40 52/592.1
6,032,424 A * 3/2000 Dial, Jr. ..... B28B 7/162 52/439

(Continued)

*Primary Examiner* — Brian D Mattei
*Assistant Examiner* — Joseph J. Sadlon
(74) *Attorney, Agent, or Firm* — Desireé J. C. Goff

(57) ABSTRACT

The primary objective of the present invention is to provide an interlocking, interchangeable wall system allowing for the formation of a plurality of form structures. Each parallel sidewall is embedded with stones or other materials into a composition base on one side. On the opposite side, the sidewalls are embedded with metal lathing and hardware to connect to bracing which connects to the opposing sidewall to form a plurality of structures, including an interlocking block system. Each sidewall interlocks with the panel or block next to it. When connected, the resulting interlocking composite blocks may be used in the construction of walls or other structures. The resulting sidewalls may be used in the decoration of existing construction or other structures. The present invention provides a significant improvement in labor and customization of structures.

7 Claims, 9 Drawing Sheets

(56) References Cited

U.S. PATENT DOCUMENTS 6,070,380 A * 6/2000 Meilleur ..... E04B 2/8617 52/309.11
6,231,024 B1 * 5/2001 Kugimiya ..... B25B 27/146 249/33
6,689,451 B1 * 2/2004 Peng ..... B32B 7/12 428/294.7
6,691,486 B1 * 2/2004 Durand ..... E04B 2/8647 52/645
6,962,028 B2 * 11/2005 Banova ..... E04B 2/44 52/379
6,978,581 B1 * 12/2005 Spakousky ..... E04B 2/8635 52/405.4
7,073,306 B1 * 7/2006 Hagaman ..... E04B 1/35 249/20
7,748,192 B2 * 7/2010 Ryder ..... E04C 5/168 52/569
7,882,672 B2 * 2/2011 Emblin ..... E04B 1/161 52/562
7,937,897 B2 * 5/2011 Kitagawa ..... E04H 9/02 52/167.5
8,127,505 B2 * 3/2012 Lu ..... E04C 2/521 52/220.2
8,234,828 B2 * 8/2012 MacDonald ..... E02D 29/02 52/391
8,656,678 B2 * 2/2014 MacDonald ..... E04B 1/04 52/562
9,021,762 B1 * 5/2015 DePalma ..... E04B 2/22 52/596
9,476,200 B2 * 10/2016 Gomes ..... E04C 1/397
9,670,640 B2 * 6/2017 Castonguay ..... E04C 1/395
10,669,715 B2 * 6/2020 Norford ..... E04B 2/24
2007/0278381 A1 * 12/2007 Marker ..... E04B 2/8635 249/189
2009/0056256 A1 * 3/2009 Blomquist, Jr. ..... E04B 2/845 52/309.8
2009/0288358 A1 * 11/2009 Snyder ..... E04F 19/061 52/302.1
2010/0263313 A1 * 10/2010 MacDonald ..... E04B 2/842 52/483.1
2010/0325997 A1 * 12/2010 Scully ..... E04F 13/0805 52/489.1
2012/0227346 A1 * 9/2012 Tsambasis ..... E04C 2/12 52/745.09
2015/0308113 A1 * 10/2015 Blum ..... E04C 1/40 52/404.4
2018/0100302 A1 * 4/2018 Olarte Michel ..... E04C 1/397

* cited by examiner

EMBEDDED INTERLOCKING CROSS MEMBER BLOCKS

FIELD

The present invention is directed to interlocking embedded blocks for specialized wall systems, building exteriors and decorative architecture features. The primary objective of the invention is to provide an interlocking, embedded block with the capability of interchangeable connectors or cross members which provide customization and drastically lessens the labor and expense of creating wall systems for a variety of structures.

BACKGROUND OF THE INVENTION

The construction industry has made significant steps in improving and fabricating concrete blocks in the construction of walls, homes, apartment houses, office buildings and many other structures. It is well known to place concrete blocks in a staggered relationship and utilize reinforcing bars and concrete for additional stability. It is also known to use aesthetically pleasing veneer paneling overtop of these concrete blocks. In addition, mortarless block construction has previously been applied. Generally, some degree of skill is required to lay the bricks and build a wall system, and because of the skill required for such construction, construction costs of these structures are not the most economically viable.

Various types of mortarless interlocking blocks have been devised to facilitate the construction of block walls and other structures. These are often very expensive due to the interlocking portions needing to be cut into blocks after they are formed. Additionally, it can be hard to estimate the accuracy of large projects when making the molds for the blocks. Specialized blocks of prior art have been used successfully for many years. While generally effective, prior art block designs often require multiple configurations for openings and require the manufacture of additional expensive molds and increased cost and time in changing molds.

Concrete blocks, interlocking blocks, veneered blocks and webbed blocks are all common in construction today. These materials are used for structural and aesthetic purposes. Interlocking concrete blocks containing webbing between the front and back were used in U.S. Pat. No. 4,640,071. This patent also defined a "web" as a projection extending at right angles from the interior surface of a side wall. The feature of interchangeable webbing between the front and back block portions was discussed U.S. Pat. No. 7,748,192 in which two side panels comprising the building block were spaced apart by two bridging parts, with a removable section on at least one bridging part, and recessed or protruding formations on the open ends to enable interlocking or interconnecting of the blocks. The removable sections allowed reinforcing rods as well as the lateral flow of concrete as necessary. These removable sections and cross members are flexible but do not have embedded receivers which the braces connect to. The present invention corrects this by providing embedded receivers which allows for various bracing sizes to be used which can increase and decrease the width of the block.

Veneer facing on cement or mortar backing panels has been in existence for several decades, and veneer blocks as indicated in U.S. Pat. No. 8,234,828 B2 to MacDonald are also known in the art. McDonald assembles blocks and then adds the veneer panel to the block. This however requires additional time and cost after the construction of the wall is completed in order to add on ornamental features. U.S. Pat. No. 6,032,424 contains an exterior finish already built into the block, however the extensive cage support system for each block, and the inability to work with metal and steel construction rods, makes it cumbersome and not as workable around existing construction codes and standard construction practice.

The embedded interlocking cross member block meets a need in the art for a concrete block which already has ornamental stone embedded into it and which can have varying widths while interlocking with the blocks on each side. It is different than prior disclosed veneer blocks due to the embedded stone in each block. This feature enables the block to be useful for a wall unit, cladding, water feature, retaining wall, and other ornamental and aesthetic purposes in addition to structural purposes.

The present invention cuts down on installation costs, labor and time, and adds to the flexibility of the user by enabling them to determine the width of the brick structure and customize it with rebar and added concrete stabilization as desired. The embedded stone facing may be made up of natural decorative stone, brick or tile in a variety of patterns.

Previous patents, such as U.S. Pat. No. 8,656,678 have directed attention to blocks which contain a connector allowing a veneer to be attached with variable veneer faces. This falls short however because it fails to address the need to minimize cost and labor, and they fail to take into account that many consumers wish to approach home improvements or wall improvements with a "do-it-yourself" (DIY) approach. This block system is all inclusive, providing an aesthetically pleasing wall system with interlocking, mortarless blocks, interchangeable cross members to modify the width of the brick, and embedded stone, brick, or tile facades avoiding the aforementioned problems of finish work and hiring labor to install feature walls, landscaping walls or any other wall structure.

It is further an object of the invention to provide for a process for using the modified blocks in order to construct structures with desired architectural detail with minimal labor. No exterior finishing work is required to be added during construction because all desired finishes and desired shapes, both decorative and functional, are already part of this structural product. The structural integrity of the building, the interior finish surfaces, the weather controlling aspect, and the complete decorative aspect are all one and the same in this product.

There exists a continuing need for improvements in construction block systems to permit lower cost manufacturing and lower cost and more rapid structure assembly from the blocks. Further the need for increased structural strength and integrity persists. Also, the need for aesthetics. The present invention provides an interlocking block system useful in construction of various structures which meets these continuing needs. Further, the blocks of the present invention, by virtue of their design, lend themselves well to mass production of readily interchangeable blocks.

What is an object of the present invention to provide, is internal facing on one side of a modular block and external embedded feature making up a sidewall, with the internal facing being connected to opposing internal facing and external embedded feature making up the second sidewall by a metal cross member brace forming a block which interlocks with a modular block on either side and connects by an adjoining metal brace. This structure allows for additional internal steel rods or bars or other support structure and the ability to pour concrete as desired.

Additional uses of this block system include landscaping, outbuildings, internal structures, and any form or building which is benefitted by such modular block or interlocking wall system.

| REFERENCES | | |
|---|---|---|
| 4,075,808 | Sanford Pearlman | 1978 |
| 6,032,424 | Ted. C. Dial, Jr. | 2000 |
| 6,962,028 B2 | Aldo Banova | 2005 |
| 6,978,581 B1 | John G. Spakousky | 2005 |
| 7,748,192 | George R. Ryder | 2010 |
| 8,234,828 B2 | Robert A. McDonald | 2012 |
| 8,656,678 B2 | Robert A. McDonald | 2014 |
| 9,021,762 | Frank DePalma | 2015 |
| 9,476,200 B2 | Francisco Gomes | 2016 |

BRIEF SUMMARY OF THE INVENTION

The primary objective of the invention is to provide an interchangeable interlocking building block suitable for use as a retaining wall, fencing, landscaping, or other wall structure. The interlocking block is formed in a specially constructed mold with metal lathing, embedded hardware, and composition of mortar and additives which enables it to expand in colder temperatures and contract in hotter temperatures. The objective of this composition mortar is to prevent moisture and temperature variations from affecting the embedded stones, bricks, tiles or other materials.

The presently disclosed invention relates to an interlocking block which allows for the formation of a plurality of structures. Each block interlocks with the block next to it. Each block is capable of changing width due to the interchangeable brace cross member which connects the parallel sidewalls.

The present invention provides load bearing capacity in combination with concrete and structural support as defined in the geographic locale.

The present invention is useful in construction of retaining walls, fencing, landscaping, feature walls, or other brick structures.

Another objective of the invention is to provide an interlocking sidewall panel embedded with stone, brick, tile or other material as a feature wall, landscaping or other aesthetic purpose which is attached in place by metal lathing extending above the top of the interlocking panel. The interlocking panel is able to be installed year round, does not have mortar so it is not in danger of weather extremes, and is constructed to be watertight while creating a gap between the panel and surface area it is covering.

The present invention has additional uses in industrial, construction and consumer applications. The present invention lessens the labor and cost associated with feature walls as it enables the consumer to put it up on their own.

Certain embodiments disclose specially constructed form structures to account for corners and end pieces of the wall structure.

In certain embodiments, only one sidewall of the block could be used as an interlocking embedded stone facade or veneer to an existing structure. In this embodiment, the metal lathing may be used to connect the sidewall to the existing structure.

BRIEF DESCRIPTION OF THE DRAWINGS

FIG. 1 illustrates block 100 of the present invention.

DETAILED DESCRIPTION AND BEST MODE OF IMPLEMENTATION

The present invention provides a combination comprising sidewalls, interchangeable cross-member bracing, embedded stones, tiles or other materials, and interlocking shapes to create an entirely new block structure that is capable of forming a variety of structures. The present invention comprises a variety of molded sidewall panels made out of a composition mortar and additives with embedded hardware for connectors and metal lathing on the interior sidewall. The exterior sidewall contains embedded stones, bricks, tiles or other materials. Each panel is capable of interlocking with the panel on either side of it. Each sidewall panel is connected via a cross-member brace to a parallel sidewall panel. The cross-member braces are interchangeable providing flexibility in width of the block. Each block can be put together and placed in the desired location by the end consumer. While suitable for construction purposes, it can also enhance the "do-it-yourself" consumers as well. The invention is mainly described with reference to its application in landscaping, retaining walls, fencing and other decorative sidewalls. The present invention is also capable of being load-bearing for structural capabilities if the hollow interior is filled with concrete and metal or steel rods as necessary. The term sidewall as used herein refers to one embedded interlocking panel.

The present invention comprises a building block that is already decorated in aesthetically pleasing stonework or other materials.

In a preferred embodiment of the invention, there is a plurality of wall blocks, comprising parallel sidewalls, cross-member bracing connecting each sidewall across the cavity, and cross-bar connecting each sidewall horizontally to the block on either end which each sidewall interlocks with. Embedded hardware in each sidewall panel for receiving a bolt and a bolt hole located in each cross-member bracing line up to connect each sidewall panel. A bolt hole in the cross-bar lines up to connect the sidewall panels on each end. Embedded stone work is visible on the exterior of both sides of this plurality of wall blocks.

In another embodiment of this invention, the sidewall panel is modified and comprises an interlocking shape with a front and rear face. The front face is embedded with stones, bricks, tiles or other materials. The rear face contains the metal lathing with composite mortar and additives. In this embodiment, the metal lathing extends above the top of the rear face and there is no embedded hardware for connecting to a cross-brace. This sidewall panel may be bolted to a wall or structure to create a feature wall of stone, brick or other material.

In another embodiment of this invention, the blocks are specially constructed form structures to account for corners and end pieces of the wall structure.

Figure 1:
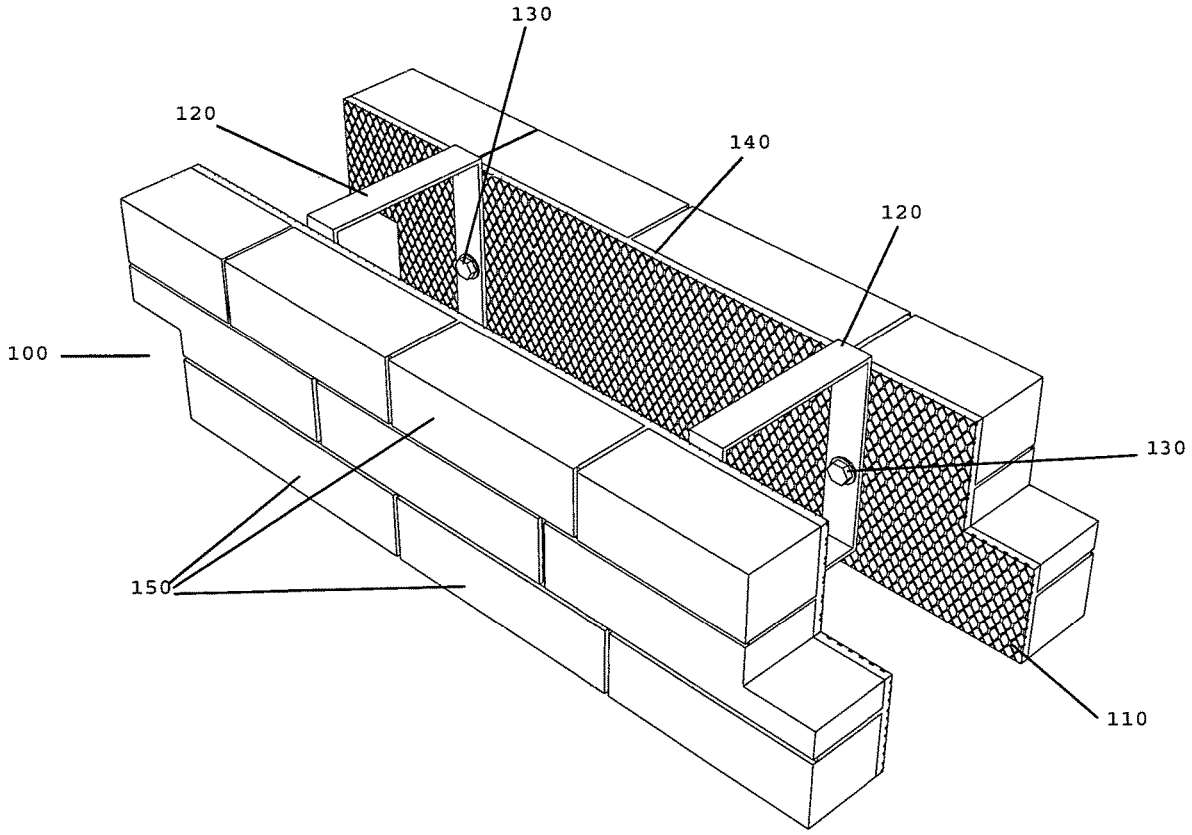
FIG. 1 illustrates an angled view of an embodiment of the present invention.

FIG. 1 illustrates block 100 of the present invention. This block illustrates the metal lathing on each interior sidewall 110. FIG. 1 additionally illustrates the cross member bracing connecting each sidewall 120, the embedded hardware connecting the cross member bracing to each sidewall 130, the mortar composition and additive 140, and the embedded facade of stone, brick, tile or other material 150.

Figure 2:
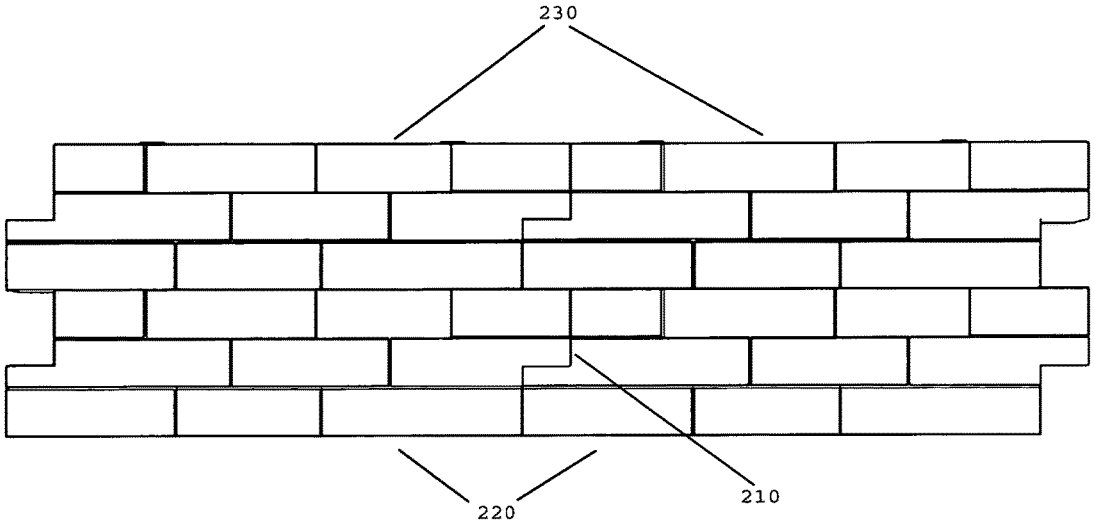
FIG. 2 is an exterior view of multiple block 100*s* in place to create a wall.

FIG. 2 demonstrates how each block interlocks horizontally with the blocks on either side 210. Two blocks interlock on the bottom row 220, with two more blocks interlocking on the top row 230.

Figure 3:
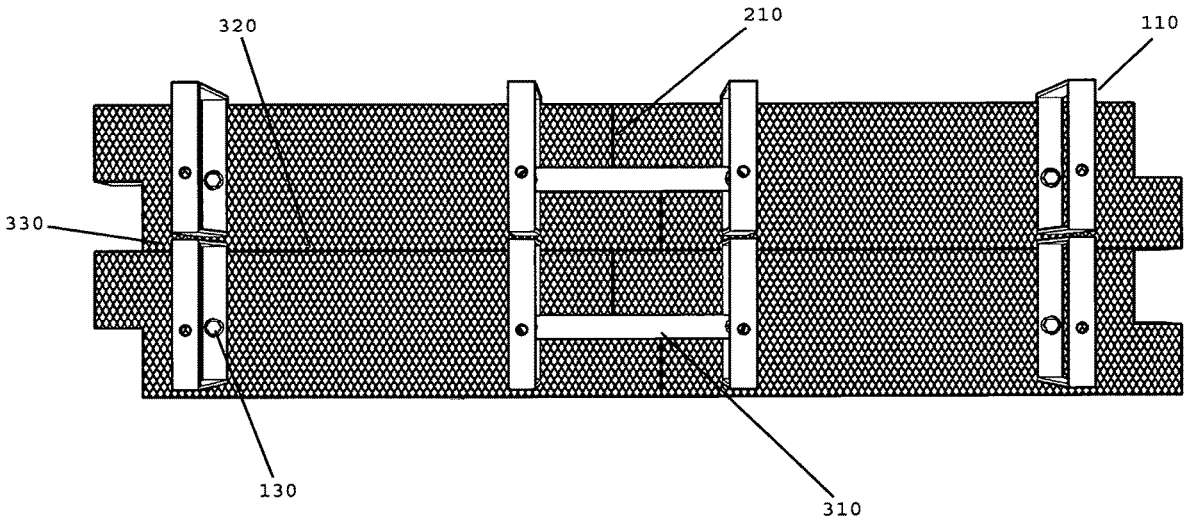
FIG. 3 is an internal view of FIG. 2 showing one sidewall.

FIG. 3 demonstrates how each interlocking block is connected to the interlocking block next to it via a metal cross-bar 310. FIG. 3 also demonstrates how the top level of blocks meets the lower level of blocks 320, how the inside of the blocks overlap 210, and how in certain embodiments the cross-brace 110 can provide additional stability at the junction 330. From the internal view of FIG. 3, the embedded hardware 130 which connects the cross-brace to the sidewall is visible.

Figure 4:
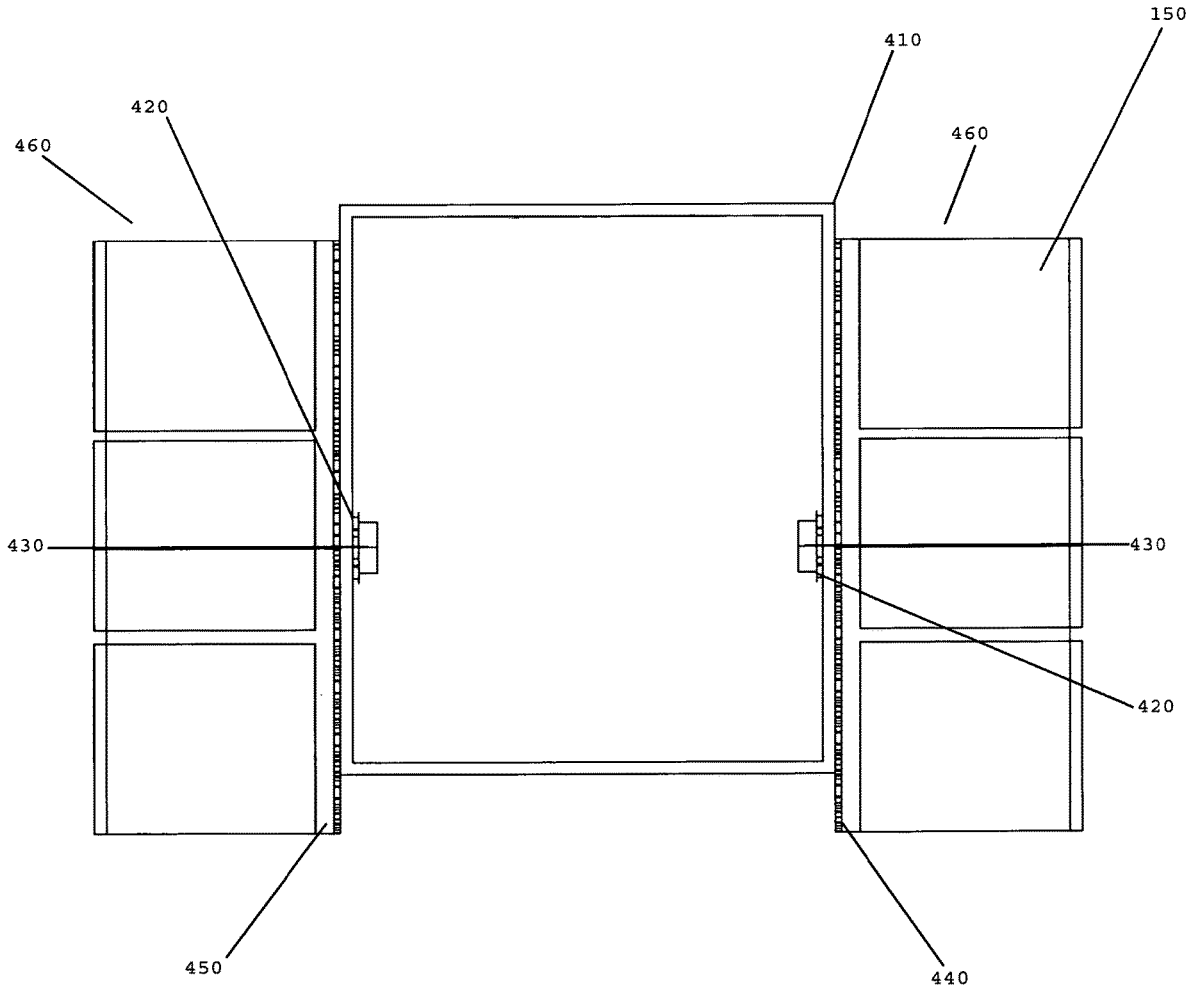
FIG. 4 is a vertical cross-sectional view of block 100 taken along line 160 in FIG. 1.

FIG. 4. Illustrates the cross member brace 410 which connects each sidewall 460. Embedded hardware 420 matches up with the cross member brace 410 and a hardware bolt 430 is used to connect the brace to the sidewall. FIG. 4 also illustrates the metal lathing 440 at the base of the mortar composition 450 and additive 410 and the embedded stone 150.

Figure 5:
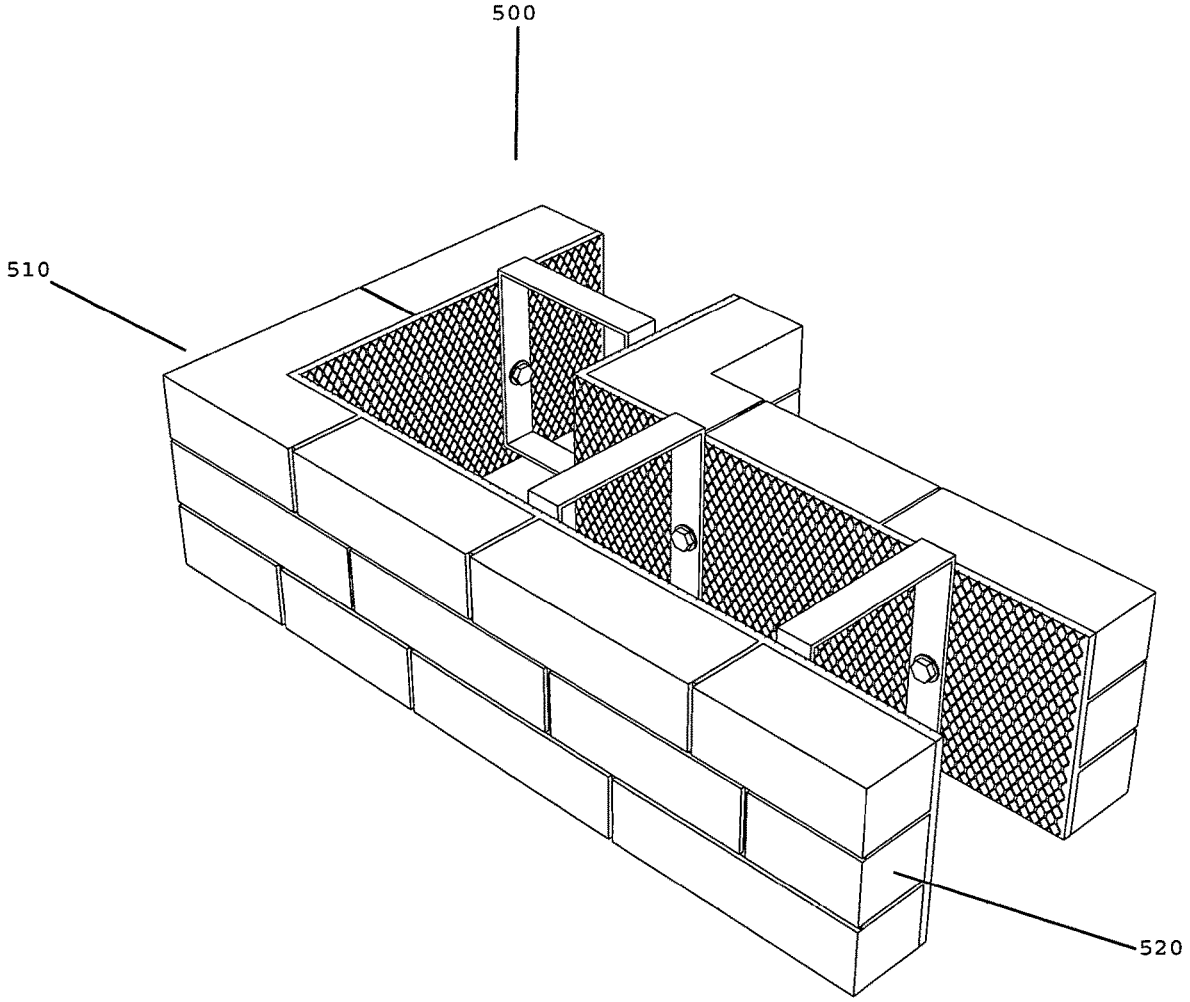
FIG. 5 is a perspective view of one embodiment of this invention, the corner block 500.

FIG. 5. illustrates how the block makes a 90 degree corner turn 510 and in certain embodiments it has non-interlocking sides 520.

Figure 6:
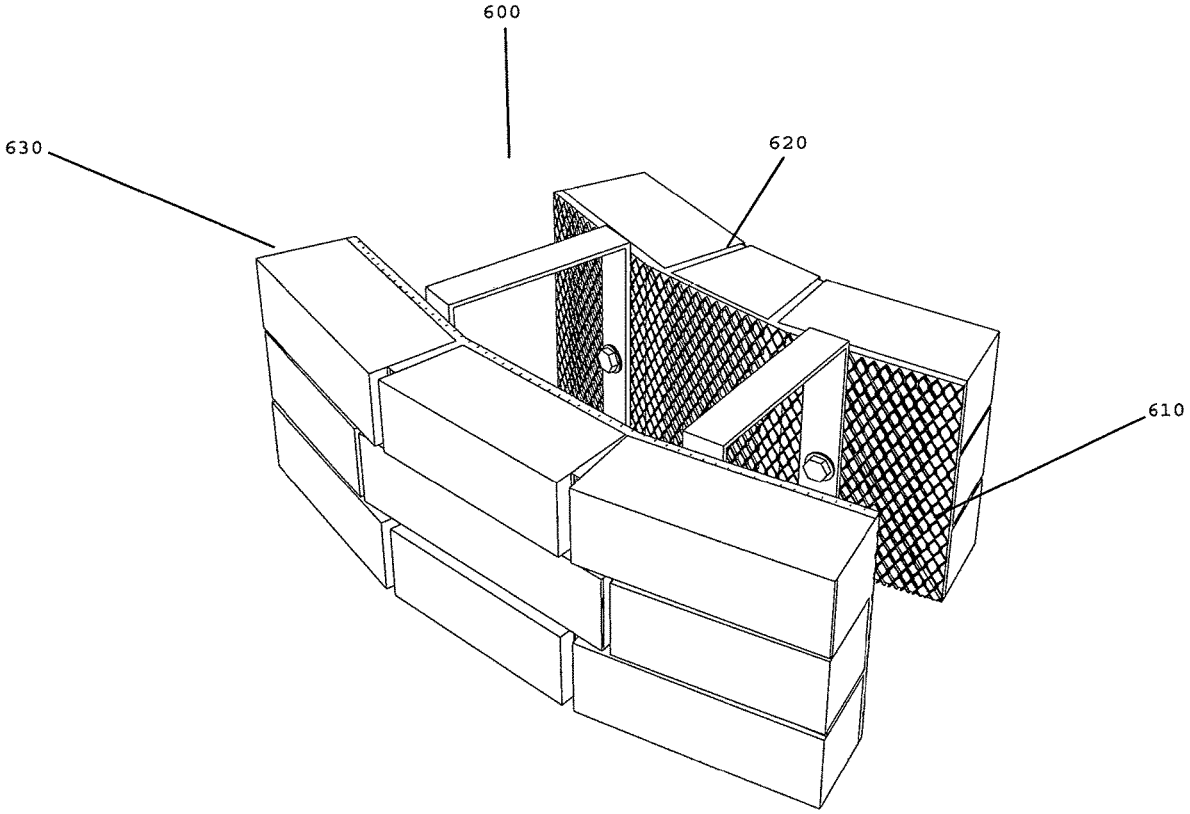
FIG. 6 is a perspective view of one embodiment of this invention, the curved block 600.

FIG. 6. demonstrates the curved lathing 610, accompanying mortar composition 620, and embedded stone or other material 630.

Figure 7:
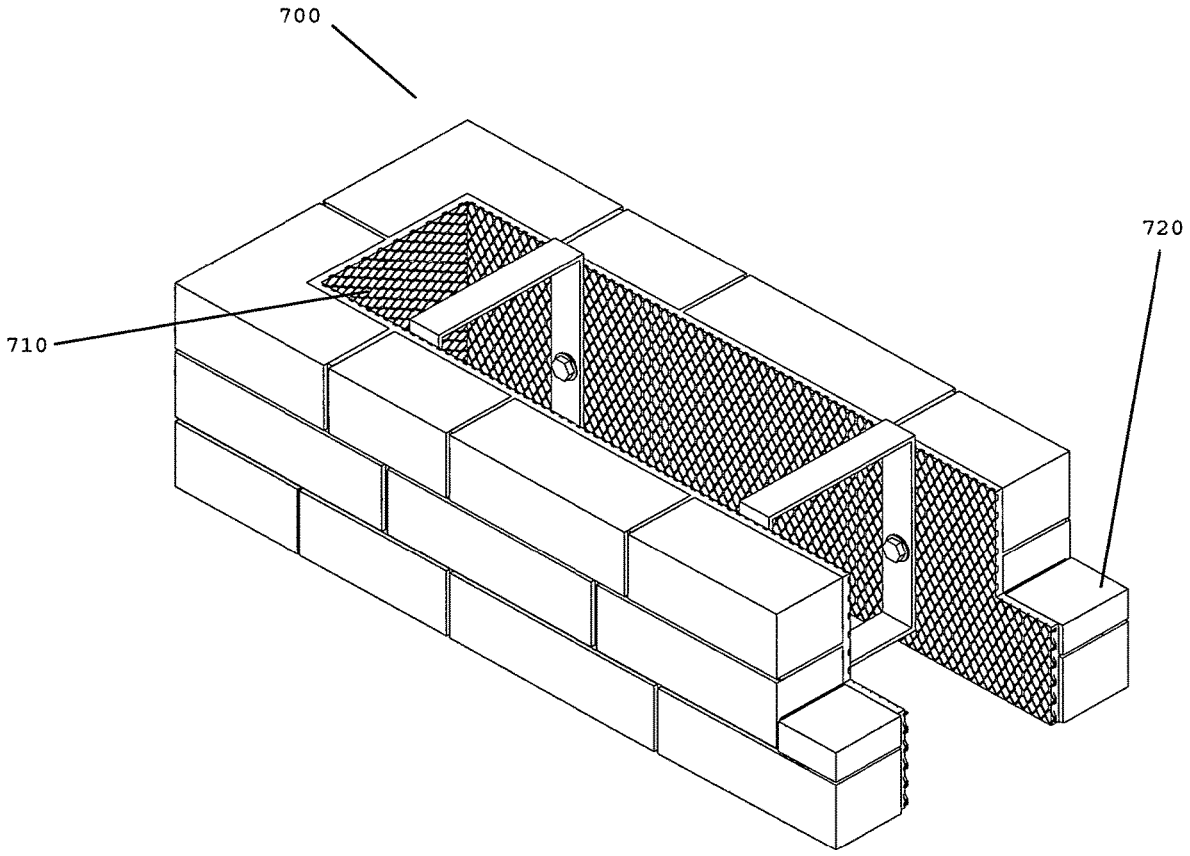
FIG. 7 is a perspective view of one embodiment of this invention, the end block 700.

FIG. 7 illustrates an end block with underhung protrusion for connecting to adjacent blocks 720. In this embodiment, the metal lathing, mortar composition, and embedded stone enclose a third side of the block 710.

Figure 8:
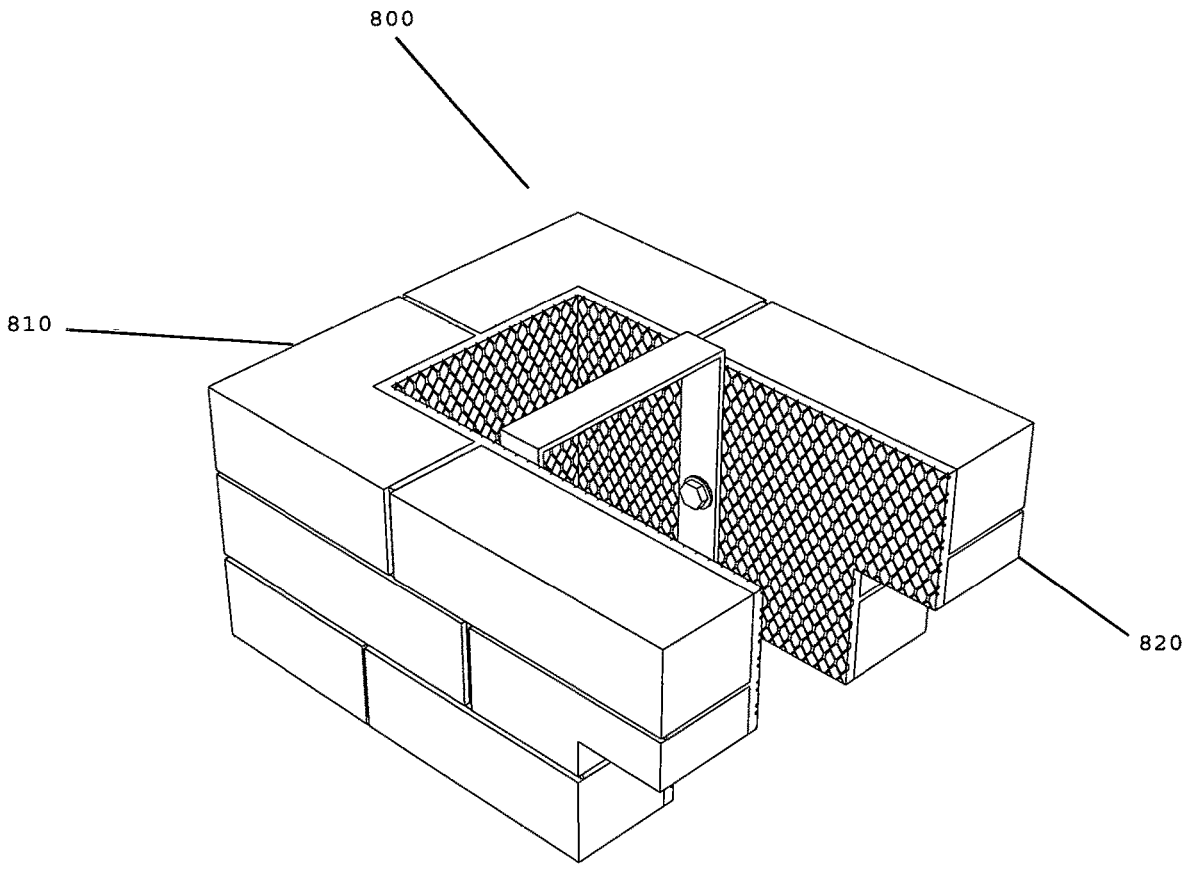
FIG. 8 is a perspective view of another embodiment of this invention, an end block 800.

FIG. 8 illustrates an end block with overhung protrusion for connecting to adjacent blocks 820. In this embodiment, the metal lathing, mortar composition, and embedded stone enclose a third side of the block 810.

Figure 9:
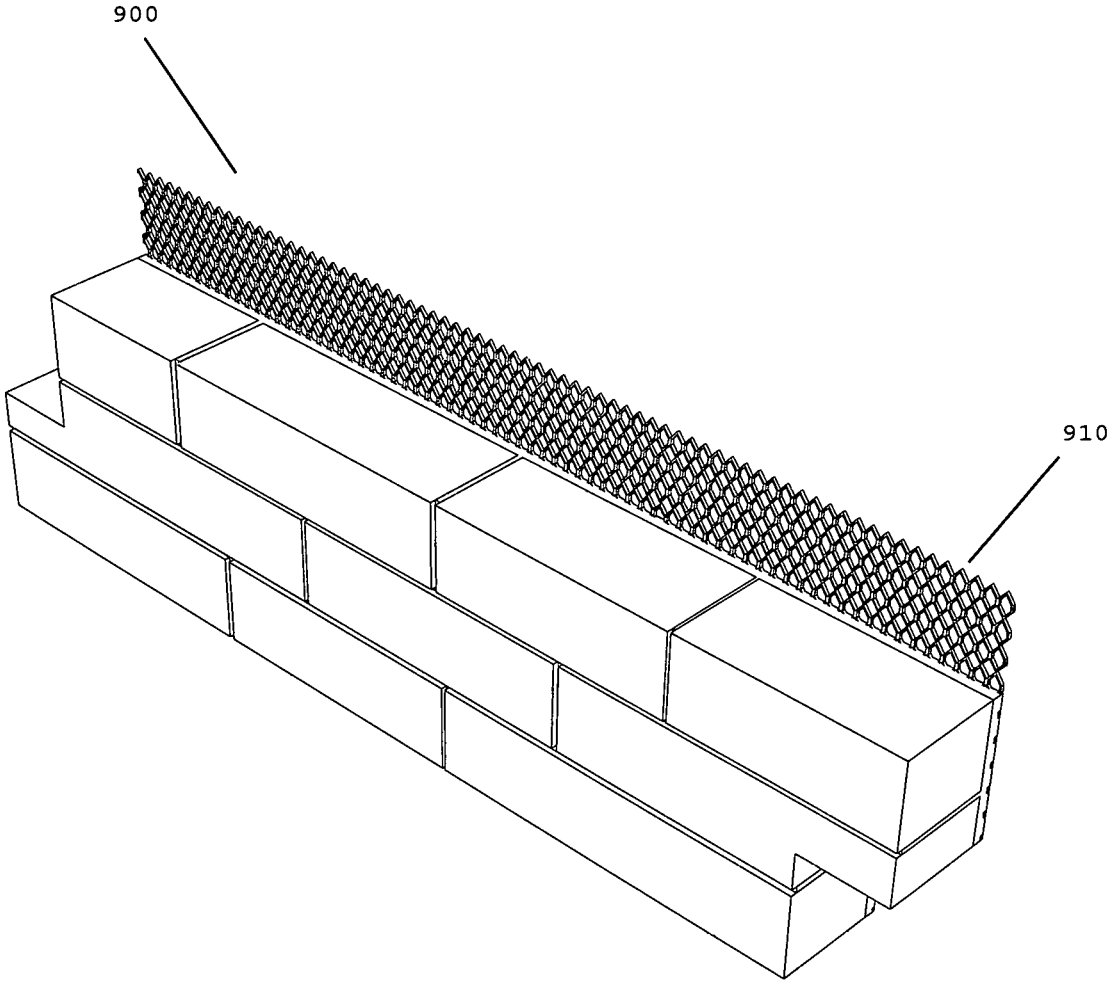
FIG. 9 is a perspective view of an embodiment of this invention.

FIG. 9 illustrates the hanging sidewall panel 900. The hanging sidewall panel is mounted to surfaces by screwing or otherwise attaching the metal lathing 910 to the desired mount. As they are mounted, each panel overlaps above the metal lathing 920 of the panel below 930 and to the side of it 910.

Figure 10:
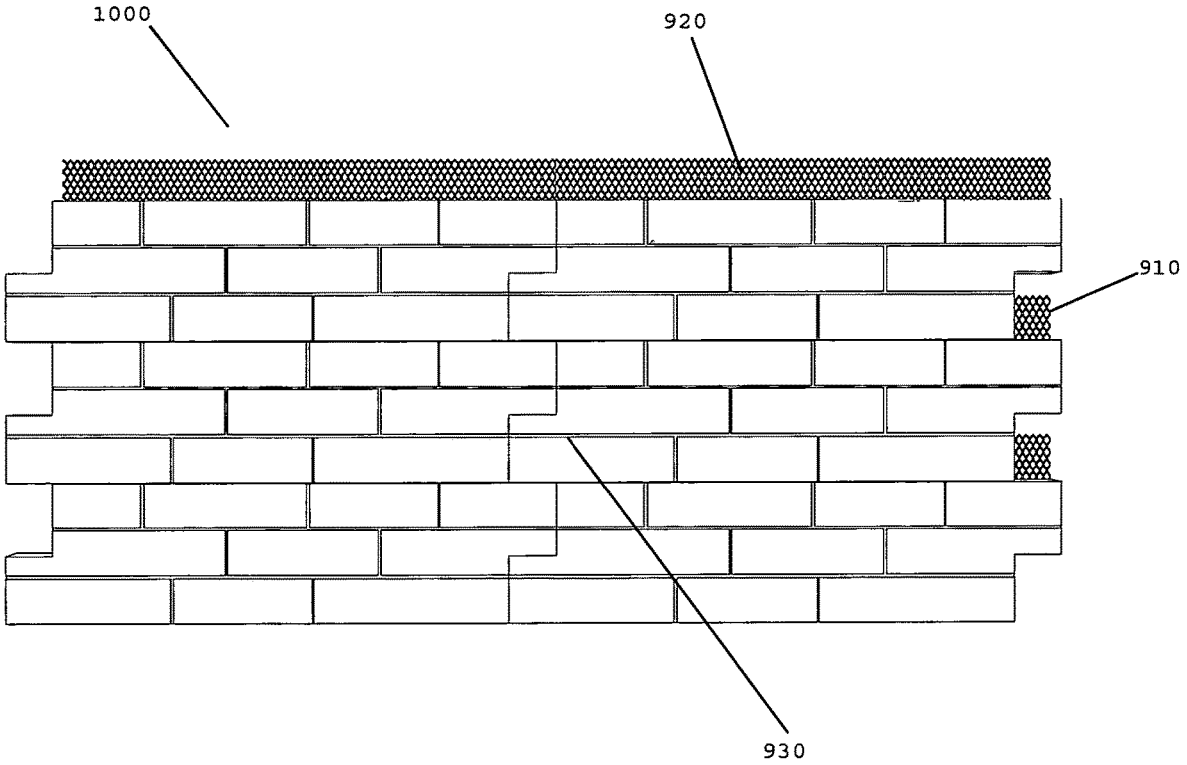
FIG. 10 is a profile view of multiple panels together.

FIG. 10 shows multiple panes 900 together as assembly 1000 illustrating how the sidewall panels overlap with the panels on the side 910 and above 920 and below 930.

The claims defining the invention are as follows:

1. A block comprising:

a set of two linear sidewall panels in interlocking shape, the panels each having an interior and an exterior face, a plurality of hardware embedded into the interior faces, a plurality of decorative stones, bricks, tiles or glass embedded into the exterior faces, a metal lathing embedded into each sidewall panel behind the plurality of hardware, and a composition mortar containing temperature resistant additives in the sidewall panels;

wherein the two sidewall panels are placed parallel to one another with the interior faces facing each other, connected by a four sided metal brace, the four sided metal brace containing two holes parallel to each other, and a connecting hardware fastener, said connecting hardware fastener joining the embedded hardware with the four sided metal brace forming a cavity between the two sidewall panels.

2. The block in claim 1 in which multiple blocks are placed next to one another and in a plurality of levels on top of one another connected by a linear metal crossbar rod, the rod containing two holes, one at each end, the rod connects to the connecting hardware fastener placed into the embedded hardware.

3. The block in claim 1 in which one of the cavity ends of the two sidewall panels connected by the four sided metal brace forming a cavity between the two sidewall panels is enclosed with the composition mortar and embedded lathing and stone material with the interlocking sidewall panels overhanging.

4. The block in claim 1 in which one end of the block is enclosed with the composition mortar and embedded lathing and stone material with the interlocking sidewall panels underhanging.

5. A block comprising:

a set of two curved sidewall panels in interlocking shape, the panels each having an interior and an exterior face, a plurality of hardware embedded into the interior faces, a plurality of decorative stones, bricks, tiles or glass embedded into the exterior faces, a metal lathing embedded into each sidewall panel behind the plurality of hardware, and a composition mortar containing temperature resistant additives in the sidewall panels;

wherein the two sidewall panels are placed parallel to one another with the interior faces facing each other, connected by a four sided metal brace, the four sided metal brace containing two holes parallel to each other, and a connecting hardware fastener, said connecting hardware fastener joining the embedded hardware with the four sided metal brace forming a cavity between the two sidewall panels.

6. A block comprising:

a set of two sidewall panels which make a 90 degree turn, the panels in interlocking shape and the panels each having an interior and an exterior face, a plurality of hardware embedded into the interior faces, a plurality of decorative stones, bricks, tiles or glass embedded into the exterior faces, a metal lathing embedded into each sidewall panel behind the plurality of hardware, and a composition mortar containing temperature resistant additives in the sidewall panels;

wherein the two sidewall panels are placed parallel to one another with the interior faces facing each other, connected by a four sided metal brace, the four sided metal brace containing two holes parallel to each other, and a connecting hardware fastener, said connecting hardware fastener joining the embedded hardware with the four sided metal brace forming a cavity between the two sidewall panels.

7. A block comprising:

a set of two linear sidewall panels having non-interlocking side shapes, the panels each having an interior and an exterior face, a plurality of hardware embedded into the interior faces, a plurality of decorative stones, bricks, tiles or glass embedded into the exterior faces, a metal lathing embedded into each sidewall panel behind the plurality of hardware, and a composition mortar containing temperature resistant additives in the sidewall panels;

wherein the two sidewall panels are placed parallel to one another with the interior faces facing each other, connected by a four sided metal brace, the four sided metal brace containing two holes parallel to each other, and a connecting hardware fastener, said connecting hardware fastener joining the embedded hardware with the four sided metal brace forming a cavity between the two sidewall panels.

* * * * *